United States Patent [19]

Dumoulin

[11] Patent Number: 5,048,427

[45] Date of Patent: Sep. 17, 1991

[54] RAILWAY TRUCK ASSEMBLY WITH SIDE BEARING HEIGHT ADJUSTER

[75] Inventor: Raymond Dumoulin, Rosemère, Canada

[73] Assignee: Bombardier Inc., Boucherville, Canada

[21] Appl. No.: 515,417

[22] Filed: Apr. 27, 1990

[51] Int. Cl.[5] ..... B61F 5/14

[52] U.S. Cl. ..... 105/199.3; 384/423

[58] Field of Search ..... 105/199.1, 199.3, 199.4, 105/200, 202, 206.1, 207, 208, 197.05, 197.1, 158.2, 453, 158.1; 248/638; 267/3; 384/423

[56] References Cited

U.S. PATENT DOCUMENTS

| | | | |
|---|---|---|---|
| 3,523,505 | 8/1970 | Lich | 105/199.2 |
| 4,108,080 | 8/1978 | Garner et al. | 105/199.3 |
| 4,434,720 | 3/1984 | Mulcahy et al. | 105/199.3 |
| 4,712,487 | 12/1987 | Carlson | 105/199.3 |

*Primary Examiner*—Douglas C. Butler

*Assistant Examiner*—Mark T. Le

*Attorney, Agent, or Firm*—Oblon, Spivak, McClelland, Maier & Neustadt

[57] ABSTRACT

In a truck assembly for a railway vehicle wherein the assembly has a truck frame defined by opposed side frame sections and a transom section extending transversely between the side frame sections and substantially at mid-length thereof. A pair of wheels are supported between opposed ends of the side frame sections. A truck bolster assembly is supported above the transom for supporting a cab thereon. The bolster assembly is retained in position relative to the transom by a central pivot. The improvement comprises side bearing height adjusters which are removably secured between the truck frame and the truck bolster assembly and spaced from the central pivot on a respective side thereof. The side bearing height adjusters have a bearing element with a top friction support surface to permit horizontal displacement of the bolster assembly about the central pivot.

12 Claims, 3 Drawing Sheets

RAILWAY TRUCK ASSEMBLY WITH SIDE BEARING HEIGHT ADJUSTER

BACKGROUND OF INVENTION

1. Field of Invention

The present invention relates to an improved truck assembly for a railway vehicle and wherein side bearing height adjusters are removably secured between the truck frame and the truck bolster assembly whereby to provide height adjustment of the truck bolster relative to the truck frame. The side bearing height adjusters also transfer the vertical load from the bolster to the truck frame and prevent the truck from hunting by restraining the relative rotational in displacement between the truck frame and to the bolster.

2. Description of Prior Art

During use, the wheels of railway trucks wear down due to friction between the wheel bearing surface and the rails. Such wear is caused by various factors such as curving and braking which both cause the wheel flange tread to wear. With railway vehicles, it is also important to maintain the floor level of the vehicle at a certain height relative to the rail surface in order for the vehicle to lie at a specific height relative to loading platforms, and other adjacent coupled vehicles, etc., and this is affected by the wear of the wheels. The usual practice to adjust the floor height when the wheels wear down, is to lift the cab of the vehicle to expand the supporting springs provided either on the bolster assembly or between the frame and the axle box and to place shims under these springs. This procedure has been found to be complex, time consuming and costly.

SUMMARY OF INVENTION

It is a feature of the present invention to provide a new truck assembly having side bearing height adjusters which substantially overcomes the above-mentioned disadvantages of the prior art.

Another feature of the present invention is to provide an improved truck assembly having side bearing height adjusters removably secured between the truck frame and the truck bolster assembly and wherein height adjustments can be made by simply lifting the truck bolster to separate it from the truck frame and removing the height adjusters.

Another feature of the present invention is to provide an improved truck assembly having side bearing height adjusters which provide for height adjustment between the cab supported on the bolster and the truck frame, and which act as a side bearing to control truck hunting and to transfer the vertical load from the bolster to the truck frame.

According to the above features, from a broad aspect, the present invention provides a truck assembly for a railway vehicle wherein the assembly has a truck frame defined by opposed side frame sections and a transom section extending transversely between the side frame sections and substantially at mid-length thereof. A pair of wheels are supported between opposed ends of the side frame sections. A truck bolster assembly is supported above the transom for supporting a cab thereon. The bolster assembly is retained in position relative to the transom by a central pivot. The improvement comprises side bearing height adjusters which are removably secured between the truck frame and the truck bolster assembly and spaced from the central pivot on a respective side thereof. The side bearing height adjusters have a bearing element with a top friction support surface to permit horizontal displacement of the bolster assembly about the central pivot.

BRIEF DESCRIPTION OF DRAWINGS

A preferred embodiment of the present invention will now be described with reference to the example thereof as illustrated in the accompanying drawings, in which.

DESCRIPTION OF PREFERRED EMBODIMENTS

Figure 1:
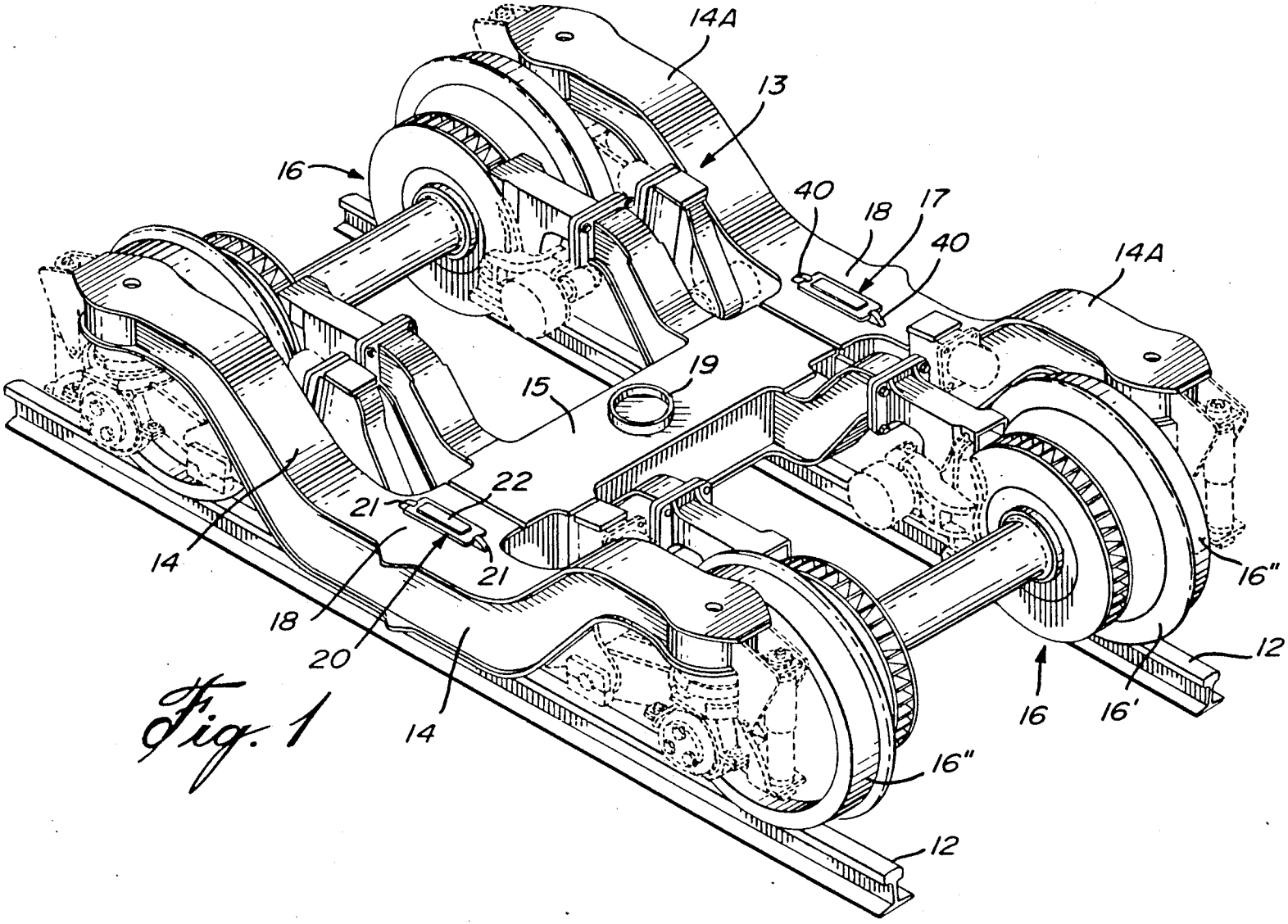
FIG. 1 is a perspective view of a railway truck assembly, without the bolster assembly showing the location of the side bearing height adjusters of the present invention.

Referring now to the drawings, and more particularly to FIGS. 1 to 4, there is shown generally at 10, a truck assembly for supporting a railway vehicle cab 11 on rails 12. The truck assembly comprises essentially a truck frame 13, as shown in FIG. 1, which is defined by opposed side frame sections 14 and **14*a* and a transverse section or transom 15. The transom 15 usually extends substantially at mid-length between the opposed side frame sections 14 and 14*a*. A pair of wheel assemblies 16 are supported between opposed ends of the side frame sections 14 and 14*a***, as is well known in the art.

Figure 2:
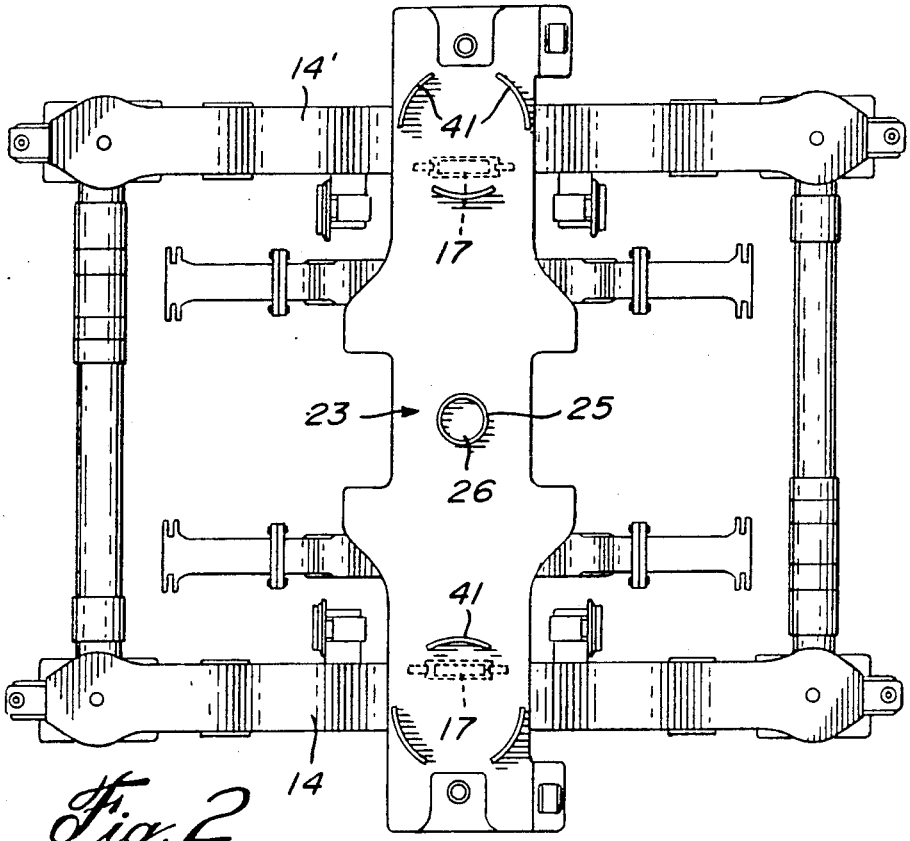
FIG. 2 is a top view of FIG. 1 with the cab support coil spring removed from the bolster assembly to illustrate the position of the side bearing height adjusters of the present invention relative to the bolster and the truck frame.
Figure 3:
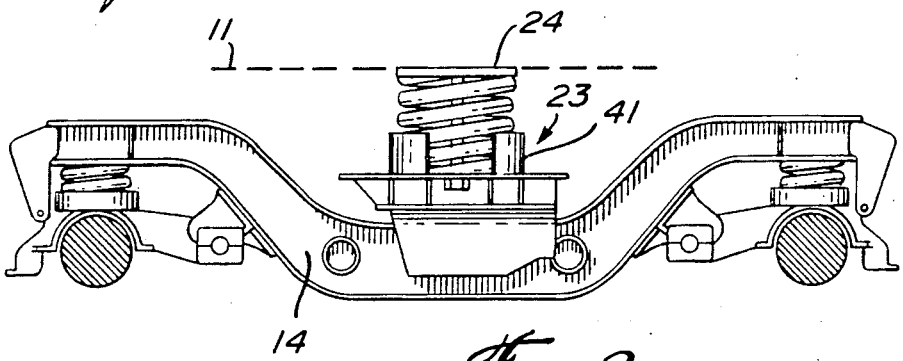
FIG. 3 is a side view FIG. 1.

The improvement in the truck assembly of the present invention resides in the provision of side bearing height adjusters 17 removably secured on a flat top surface 18 of the truck frame, herein at the intersection of the side members 14 and **14*a* and the transom 15. These side bearing height adjusters 17 are spaced-apart on a respective side of the truck frame and from a central pivot member 19 disposed centrally on the transom 15. The side bearing height adjusters are provided with a bearing element 20 which is removably secured to retention elements 21 fixed to the truck frame. The bearing element also has a top bearing plate 22 with a friction support surface to provide a restraining friction force against rotation of the bolster assembly 23, disposed over the transom and extending to the side frame sections 14 and 14*a*. The bolster assembly 23 is provided with coil springs 24 to support a cab 11 thereon in a manner well known in the art. Since the present invention relates to the side bearing height adjusters, it is not necessary to provide herein a detailed description of the truck frame, wheel assemblies or bolster assembly but only the main elements thereof. As also shown in FIGS. 1 and 2, the bolster assembly 23 is also provided with a pivot post 25 secured centrally thereto whereby to be received in the central pivot member 20 on the transom and in close friction fit therein: A central pivot member 19 is herein provided as a cup shape member and bearing means 26** is provided between the cup and the post to permit horizontal displacement between the bolster assembly and the truck frame.

Figure 4:
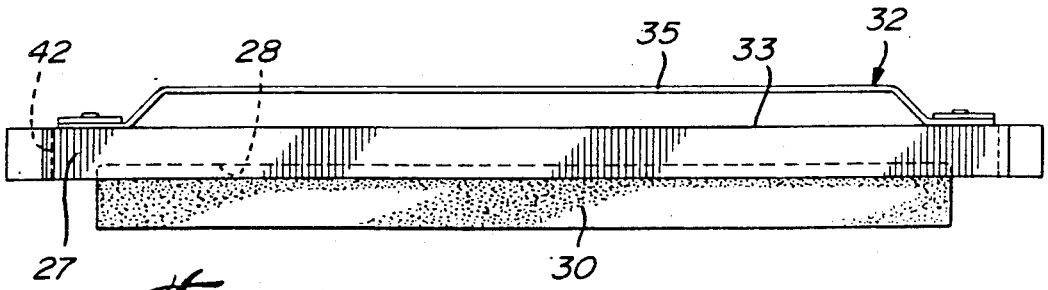
FIG. 4 is a side view of the side bearing height adjusters.
Figure 5:
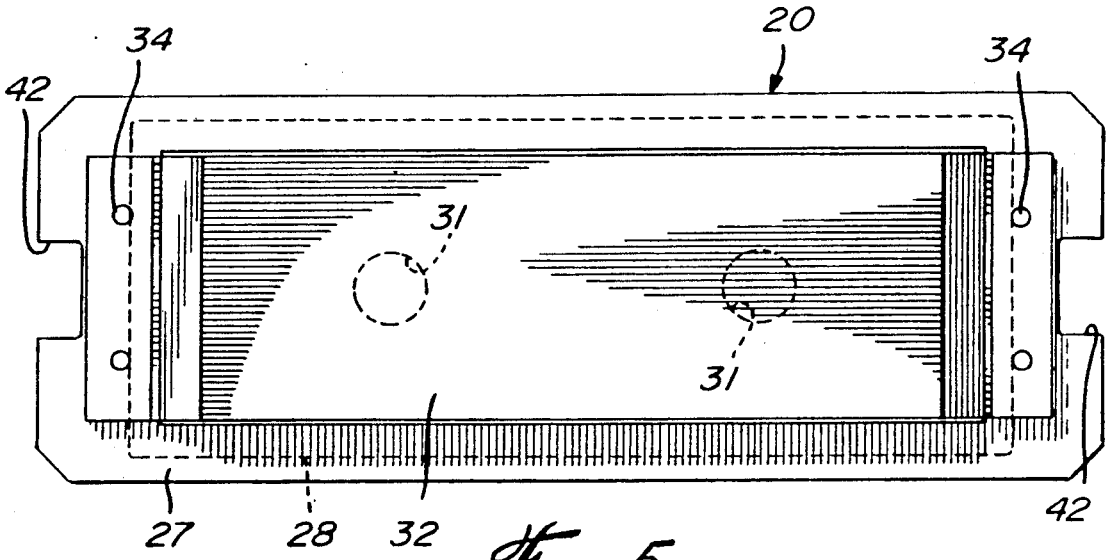
FIG. 5 is a top view of FIG. 4.
Figure 6:
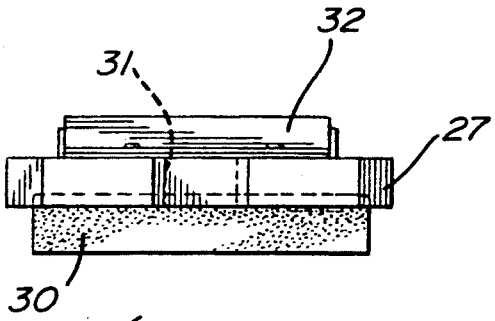
FIG. 6 is an end view of FIG. 4.

Referring now to FIGS. 4, 5 and 6, there will be described the construction of the bearing element 17. As herein shown the bearing element is comprised of a body member 27 which is a substantially rectangular member having a predetermined thickness and constitutes the height adjustment element of the height adjuster assembly. A locating cavity 28 is provided in a bottom wall of the body member 27 whereby to receive therein an elastomeric pad 30, herein constituted by a urethane material. A top section of this pad is located in the cavity to maintain the pad in alignment with the body member 27. At least, herein three through bores 31 extend through the body member 27 in the cavity to provide a vacuum break to locate the pad in the cavity and also to facilitate the removal and replacement of the pad or replacement of the height adjusting body member 27. A top bearing plate 32 which is also a rectangular plate, is removably secured on a top wall 33 of the body member 27 by means of removable fasteners 34. The bearing plate 32 has a top friction support surface 35 constituted by a lubricant bonded thereto. This friction surface is in contact with a flat bottom wall (not shown) of the bolster assembly 23.

As shown in FIG. 1, a pair of spaced-apart retention means herein a pair of rigid lugs 40 are removably secured in transverse alignment and centrally on the transom. These lugs are disposed in alignment, preferably, but not exclusively over the side frame section 14 and 14*a* as better seen in FIG. 2. The coil springs 24 are disposed over these side frame sections and the side bearing height adjusters 17 between the spring retention flanges 41 so that the vertical load from the bolster is transferred to the truck frame through the side bearing height adjusters. These side bearing height adjusters greatly reduces from hunting, i.e., oscillations of the bolster and cab relative to the frame, by restraining the horizontal displacement of the truck frame relative to the bolster.

Referring again to FIGS. 4 to 6, it can be seen that the body member 27 is provided with locating means in the form of a pair of slots 42 which are of rectangular shape and each located at an opposed end of the body member These slots are dimensioned to receive the lugs 40 in close fit therein when the bearing element is positioned between the pair of lugs. It is also pointed out that the elastomeric pad has a predetermined thickness with a known compression ratio and transfer the load and shear between the body member and the truck frame. In use, the bearing surfaces 16″ of the wheels 16′ usually wear due to hunting or other type of vibrations. This causes the floor level of the cab supported on the truck assembly to move downwards. This causes all types of problems in that the floor of the cabs are no longer aligned with unloading or loading platforms or other type platforms necessary to load and unload commodities into freight cars, or people from passenger cabs. However, with the present invention, when the wheels wear down all that is necessary to elevate the floor of the cab to the desired height is to jack or otherwise lift the bolster assembly from the truck frame in the area indicated at 45 in FIG. 2 and to lift off the bearing element 20 from its position between the lugs 40. This can be done easily by one person and the bearing element is removed by hand.

In order to provide height adjustment the elastomeric member 30 and the friction plate 32 are removed from the body 27 and a new body of greater thickness replaces the original body member so that the height adjuster becomes thicker. The new bearing element 20 is then placed back in position between the lugs 40. The same procedure is repeated on the other side of the car body. Accordingly, there is provided a simple, quick, inexpensive and efficient manner in adjusting the distance between the bolster assembly and the truck frame and to maintain the bolster level on the truck frame, from side-to-side. The side bearing height adjusters 17 further provide the advantages of transferring the vertical load from the bolster assembly to the truck frame and substantially prevent the truck from hunting by restraining the rotation of the truck frame relative to the bolster assembly.

It is within the ambit of the present invention to cover any obvious modifications of the examples of the preferred embodiment described herein, provided such modifications fall within the scope of the appended claims.

I claim:

1. A truck assembly for a railway vehicle, said assembly comprising a truck frame defined by opposed side frame sections and a transom section extending transversely between said side frame sections substantially at mid-length thereof, a pair of wheel assemblies supported between opposed ends of said side frame sections, and a truck bolster assembly supported above said transom for supporting a cab thereon, said bolster assembly being retained in position relative to said transom by a central pivot, side bearing height adjusting means including interchangeable bearing elements of different heights; said bearing elements, one at a time, being selectively positioned between said truck frame and said truck bolster assembly and spaced from said central pivot on a respective side thereof, and each said bearing element having a top friction support surface to restrain rotation of said bolster assembly about said central pivot.

2. A truck assembly as claimed in claim 1 wherein each said bearing element is further provided with an elastomeric pad disposed in a lower surface of said bearing element for supporting said bearing element in compression on a flat top wall section of said transom.

3. A truck assembly as claimed in claim 2 wherein each said bearing element comprises a body member having a locating cavity in a bottom wall thereof, said elastomeric pad having a top section thereof located in said cavity to maintain said pad in alignment with said body member, and a top bearing plate secured to a top wall of said body member, said bearing plate having said top friction support surface, and means to retain said bearing element at a predetermined location on said transom.

4. A truck assembly as claimed in claim 3 wherein said means to retain said bearing element comprises a pair of spaced apart retention means, said body member having locating means being restrained by said retention means when positioned between said spaced apart retention means.

5. A truck assembly as claimed in claim 4 wherein said spaced apart retention means comprises a pair of rigid lugs immovably secured in transverse alignment relative to said transom.

6. A truck assembly as claimed in claim 5 wherein said locating means comprises a pair of slots, each slot being provided at an opposed end of said body member, said lugs being received in a respective one of said slots when said bearing element is disposed on said transom between said pair of lugs.

7. A truck assembly as claimed in claim 6 wherein said bearing element is an elongated bearing element, said top bearing plate and said elastomeric pad being removably retained by said body member.

8. A truck assembly as claimed in claim 3 wherein said body member is provided with at least one transverse through bore extending from said body member top wall to said locating cavity to provide a vacuum break for said cavity when said pad is located therein and to further facilitate the removal and replacement of said pad.

9. A truck assembly as claimed in claim 8 wherein said pad of each said bearing element is a urethane elastomeric pad, said pad having a predetermined thickness and said interchangeable bearing elements include said body members which have variable thicknesses.

10. A truck assembly as claimed in claim 3 wherein said top friction support surface has a lubricant bonded thereto.

11. A truck assembly as claimed in claim 3 wherein said central pivot is a pivot cup secured centrally on said transom and a pivot post secured centrally to said bolster assembly and received inclose friction fit in said cup, and bearing means between said cup and said post.

12. A truck assembly as claimed in claim 11 wherein each said bearing element comprises an elongated rectangular element disposed transversely and centrally over said transom and axially aligned with a respective one of said side frame sections, said bolster assembly having a pair of cab support coil springs, said springs being aligned with said side frame sections and disposed over a respective one of said bearing elements, said bearing elements transferring a vertical load from said bolster assembly to said truck frame and substantially preventing said truck from hunting by restraining by friction the rotation of the truck frame relative to said bolster assembly.

* * * * *